United States Patent [19]

Jennings et al.

[11] Patent Number: 4,522,313

[45] Date of Patent: Jun. 11, 1985

[54] ARTICLE DISPENSER

[76] Inventors: Paul D. Jennings, 1039 E. Almond Ave., Orange, Calif. 92666; Kenneth L. Jennings, Rte. 2, P.O. Box 83-4, Strafford, Mo. 65757

[21] Appl. No.: 531,684

[22] Filed: Sep. 13, 1983

[51] Int. Cl.[3] ..... B65D 83/04

[52] U.S. Cl. ..... 221/1; 221/256; 221/288; 206/540

[58] Field of Search ..... 221/188, 189, 186, 256, 221/266, 288, 1; 206/536, 540; 222/162, 368, 454

[56] References Cited

U.S. PATENT DOCUMENTS

| | | | |
|---|---|---|---|
| 1,560,184 | 11/1925 | McLean et al. | 222/368 X |
| 1,716,883 | 6/1929 | Gesbeck | 221/266 X |
| 1,801,634 | 4/1931 | Moore | 221/288 |
| 2,134,180 | 10/1938 | Felber | 221/266 X |
| 3,161,321 | 12/1964 | Mellion et al. | 221/266 |
| 3,276,636 | 10/1966 | Johnson | 221/266 X |
| 3,318,491 | 5/1967 | Williamson | 221/266 X |
| 3,782,608 | 1/1974 | Schneider | 221/266 X |
| 4,189,066 | 2/1980 | Berghahn | 221/266 X |
| 4,285,448 | 8/1981 | Group | 222/368 X |

*Primary Examiner*—F. J. Bartuska

*Attorney, Agent, or Firm*—Martin E. Gerry

[57] ABSTRACT

An article dispenser discloses a vessel for storing at least one of the articles. Such dispenser has a sphere pivotally suspended from the vessel for rotation in only one direction about a singular first axis that is offset from a second axis and which second axis passes through the center of gravity of the sphere. The first axis lies in a plane that bisects the sphere into a pair of hemispheres where one of the hemispheres is heavier than the other hemisphere. The lesser heavy hemisphere has a cavity overlying and adjacent to the first axis and also adjacent to one of the pivotal suspension points. The article is conveyed from its stored location within the vessel into the cavity and from the cavity to a location external to the vessel by impelling the sphere. A variation of the disclosure includes a sphere that has an axis at which the sphere is pivotally rotated and which axis passes through the center of gravity of the sphere.

22 Claims, 9 Drawing Figures

ARTICLE DISPENSER

BACKGROUND OF THE INVENTION

This invention is in the field of article dispensers and more specifically of those dispensers storing and ejecting stored articles of solid substance.

One type of article dispenser is disclosed by U.S. Pat. No. 3,276,636. Such dispenser shows a modified generally cylindrical roller with a U-shaped recess along most of the roller's length for delivering the article, and wherein the roller has a U-shaped support structure to receive the article. The roller is supported on a large surface area of the support structure and thus the total structured roller support and roller movement necessitates complex mechanization to effect the principle function of picking up an article and ejecting same.

U.S. Pat. No. 3,782,608 discloses a safety closure container wherein a sphere of two sections cooperating with each other results in a marking groove at the interface of the two sections, which groove is needed for alignment of movable components to effect the transfer of the article. The sphere has a depression for receiving the article. However, such sphere is mounted on a structure auxiliary to the vessel storing the article, and further mounted in such a way that the auxiliary structure cooperates with a substantial surface area of the sphere. The sphere has virtually an infinite number of degrees of freedom rotation along a plurality of axes in its auxiliary structure. Additionally, this art has protrusions near the sphere at an exit point of the article that prevent rotation of the sphere by contact of the sphere with a planar external surface upon exerting manual force upon the vessel.

U.S. Pat. No. 4,189,066 shows a hollow ball with an opening therein, the ball being retained in a support structure that permits its rotation in the support structure in a literally infinite number of directions. The hollow ball retains the article and the opening is used to eject such article when such opening is aligned with certain structural members of the dispenser.

U.S. Pat. No. 3,318,491 shows a sphere modified by an angular portion that is removed from the sphere. Such sphere is dually supported by a support plug at the lower surface of the sphere and by a hemispherical cap at the upper surface of the sphere, such supports making a multiple number of contact points with the various areas of the sphere and making the sphere capable of rotation in any of a multiple number of directions. The sphere has a depression for receiving the article and such depression has to be aligned manually with an opening in the hemispherical cap by pushing a tab that is integral with the sphere structure and which protrudes outward from the sphere through the cap. Such protrusion also acts as an impediment to delivery of the article by rolling the sphere in contact with an external planar surface.

U.S. Pat. No. 1,716,883 is addressed to a smoker's cabinet which utilizes a hand-operated cylinder suspended from the cabinet walls, the cylinder having a slot to receive a cigarette from a hopper located above the cylinder and delivers the cigarette from an ejection means below the cylinder by manually rotating the cylinder so that the slot is 180 degrees displaced from its initial cigarette-receiving position. This structure provides no external access to the cylinder and hence does not promote the ability to impell the cylinder by contact of its surface with an external planar surface when the cabinet is manually pushed. Even if access to the external planar surface were provided, such cylinder would damage the article when its body rolls thereover upon article ejection.

SUMMARY OF THE INVENTION

An objective of this invention is to provide an article transporter of the internally solid spherical type that is pivotally suspended from an article storage vessel for enabling rotation of the sphere only about a single axis disposed from another axis passing through the center of gravity of the sphere.

Another objective of this invention is to provide a unisection solid sphere that is capable of scooping up and delivering the article by simple rotation of the sphere about its singular rotational axis without requirement of prealignment of dispenser components. Such objective includes the ability to scoop up and eject the article when spherical surface cooperation is made with an external surface and the vessel suspending the sphere is pushed across such external surface.

Still another objective of this invention is achieved when utilizing a solid internal spherical structure, instead of a hollow structure, with a cavity in the solid structure to scoop up and deliver the article.

Yet another objective of this invention includes the untilization of a sphere for transfering an article when the sphere is pivotally supported at two oppositely disposed points between the sphere and the vessel containing the article so as to limit the spherical rotation about only one specifically defined axis and thereby avoid high frictional contact imposed by major surfaces of the sphere cooperating with major surfaces of the support structure. Providing a sphere without protrusions also enables rotation of the sphere about its single rotational axis when in contact with an external surface and when the article storage compartment is physically translated across the external surface by exertion of an external force upon such storage compartment.

Yet a further objective of this invention is to provide a spherical article transfer member, part of which extends from its article storage compartment to enable the article to be picked up by the sphere in a cavity therein and ejected upon a planar surface when the sphere is rotated by rolling same over such planar surface.

Hence according to the foregoing objectives an article dispenser is provided having a vessel for storing at least one of the articles. The dispenser has a sphere pivotally suspended from the vessel for rotation in only one direction about a singular first axis that is offset from a second axis and which second axis passes through the center of gravity of the sphere. The first axis lies in a plane that bisects the sphere into a pair of hemispheres where one of the hemispheres is heavier than the other hemisphere, but such heavier hemisphere is made of a different substance such as a plastic as compared with the plastic of the lighter hemisphere, and such hemispheres are integral parts of the sphere. The lighter hemisphere has a cavity overlying and adjacent to the first axis and also adjacent to one of the pivotal suspension points of the sphere. The article is conveyed from its stored location within the vessel into the cavity and from the cavity to a location external to the vessel by impelling the sphere.

An additional variation of the invention includes the use of the sphere wherein the axis of rotation and points of sphere suspension from its storing vessel passes through the center of gravity of the sphere and thus the spherical hemispheres about a plane in which such axis lies are of the same order of weight.

DETAILED DESCRIPTION OF BEST MODE FOR CARRYING OUT THE INVENTION

Figure 1:
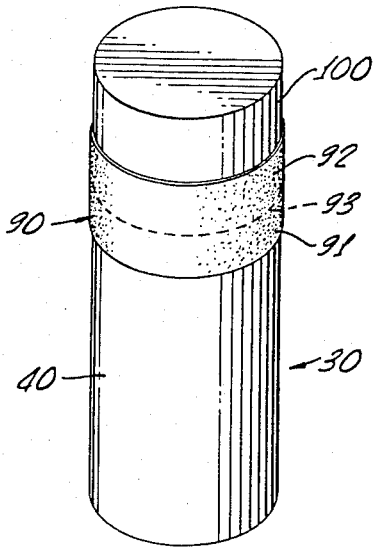
FIG. 1 is a perspective view of the article dispenser showing a tamper proof seal, sealing the article dispenser and its cover.
Figure 3:
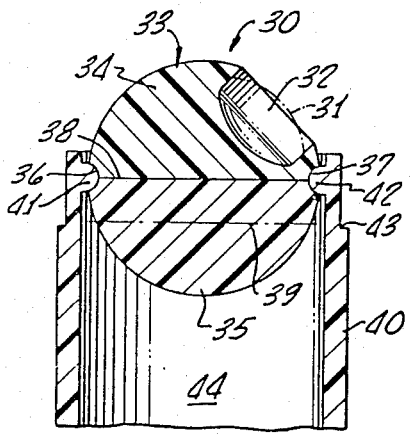
FIG. 3 is a cross-section view of a first form of the article dispenser structure.
Figure 4:
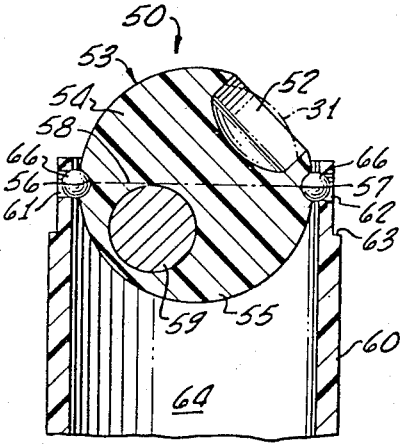
FIG. 4 is a cross-section view of a second form of the article dispenser structure.
Figure 5:
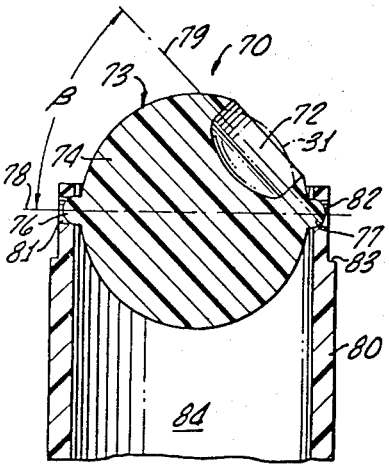
FIG. 5 is a cross-section view of a third form of the article dispenser structure.

Referring to FIG. 1, a general view representative of the different variations of the article dispenser 30, that also represents dispensers 50 and 70 all shown in cross-section views of FIGS. 3, 4 and 5, includes a cover 100 that is fitted to the dispenser 30, 50 or 70. Accessibility to the dispenser is sealed by a relatively rigid plastic collar 90 that is attached between the housing of dispenser 30 and cover 100. Collar 90 comprises two portions 91 and 92 wherein portion 91 surrounds the housing of dispenser 30 and portion 92 surrounds part of cover 100 thereby causing collar 90 to inhibit normal movement of the cover with respect to the housing. Collar 90 has a partially punctured circumference at 93 at the interface of the edge of the cover with the housing so that it is necessary to exert some measure of force in order to sever the collar at 93 thus breaking the seal between the cover and dispenser.

Figure 2:
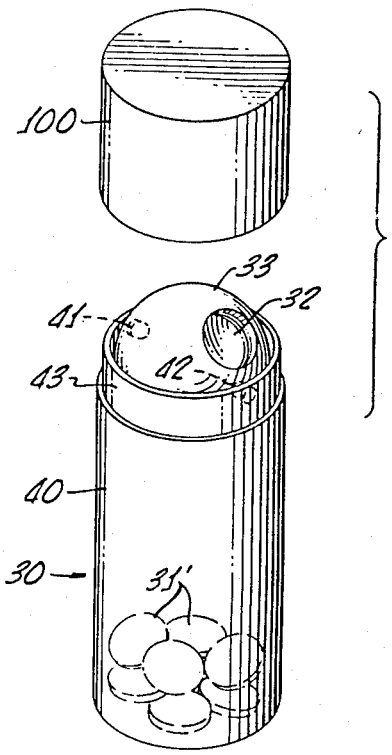
FIG. 2 is a perspective view of the article dispenser with the cover removed showing the rotatable sphere pivotally mounted in the article storage vessel.

Referring to FIG. 2, the dispenser is shown at 30, also representing a perspective view of dispensers 50 and 70, showing cover 100 removed from vessel 40 and displaying sphere 33, and inferentially spheres 53 and 73. Vessel 40 includes pills 31 in the internal confines of the vessel 44 at the base of the vessel, wherein such pills are illustrated in phantom at 31'.

Vessel 40 has a pair of oppositely disposed protrusions 41 and 42 extending from its inner surface into depressions of sphere 30, which depressions are shown in FIG. 3. A lip 43 is provided at the top of vessel 40 for enabling cover 100 with a counterpart lip structure of its own to fit thereover for closing dispenser 30.

Cavity 32 in sphere 33 overlies and is contiguous to the axis of rotation of sphere 33 about pivotal means located at 41–42 for rotation of vessel 30 with respect to sphere 33 about such pivotal means, and cavity 32 receives therein an article such as a pill 31, to be described below in greater detail.

Referring to FIG. 3, the first form of the article dispensing structure is shown at 30 wherein pill 31 is retained in cavity 32 of sphere 33. Sphere 33 is composed of a first hemisphere 34 of internally solid material such as a plastic integral with a second hemisphere 35 also of a solid material such as a plastic but of greater weight than hemisphere 34.

Sphere 33 has depressions 36 and 37 oppositely or 180 degrees disposed from each other and adapted for receiving protrusions 41 and 42 of vessel 40 so as to enable vessel 40 and sphere 33 to be pivotably rotated with respect to each other about an axis 38 extending between depressions 36 and 37. Axis 38 is offset from axis 39, which axis 39 passes through the center of gravity of sphere 33. The center of gravity of sphere 33 is defined in terms of axis 39 due to the greater weight of hemisphere 35 with respect to hemisphere 34. Offset axis 38 is the axis about which rotational motion of vessel 40 with respect to sphere 33 is obtained simply by inverting vessel 40 in view of the hemisphere weight difference, maintaining sphere 33 in the same relative position when vessel 40 is inverted, except that hemisphere 34 is now enveloped by vessel 40 in its internal confines 44 and hemisphere 35 now extends out of the mouth of vessel 40. A recessed lip is provided at 43 for fitting vessel 40 to its cover as at 100.

An angle $\beta$, as shown in FIG. 5, is likewise applicable to FIG. 3 structure and defines the location of cavity 32 with respect to the offset axis of rotation. Generally angle $\beta$ is 45 degrees, but may vary between 30 and 60 degrees. Details as to the manner that article 31 is transferred from within the confines 44 of vessel 40 to a location external vessel 40 are given below in conjunction with FIGS. 6, 7 and 8.

Referring to FIG. 4, the second form of article dispensing structure is shown at 50 wherein pill 31 is retained in cavity 52 of sphere 53. Sphere 53 is composed of a first hemisphere 54 of internally solid material such as a plastic integral with a second hemisphere 55 also of the same plastic material. Sphere 53 has depressions 56 and 57 oppositely or 180 degrees disposed from each other and adapted for receiving ball bearings 66. Each of ball bearings 66 also lies in depressions 61 and 62 within the inner confines 64 of vessel 60 so as to enable vessel 60 and sphere 53 to be rotated pivotally with respect to each other about an axis 58 extending between depressions 56 and 57. Axis 58 is offset from an axis, similar to axis 39 of FIG. 3, which passes through the center of gravity of sphere 53. The center of gravity of sphere 53 is defined in terms of the axis similar to axis 39 due to the greater weight of hemisphere 55 with respect to hemisphere 54. Such greater weight is achieved by having a weight 59 embedded within and being an integral part of hemisphere 55. Offset axis 58 is therefore the axis about which rotational motion of vessel 60 with respect to sphere 53 is obtained simply be inverting vessel 60, in view of the hemispherical weight difference, maintaining sphere 53 in the same relative position when vessel 60 is inverted, except that hemisphere 54 is now enveloped by vessel 60 in its internal confines 64, and hemisphere 55 now extends out of the mouth of vessel 60. A recessed lip is provided at 63 for fitting vessel 60 to its cover as at 100.

An angle $\beta$, as shown in FIG. 5, is likewise applicable to FIG. 4 structure defining the location of cavity 52 with respect to the offset axis of rotation. Generally angle $\beta$ is 45 degrees, but may vary between 30 and 60 degrees. Details as to the manner that article 31 is transferred from within the confines 64 of vessel 60 to a location external to vessel 60 are discussed below in conjunction with FIGS. 6, 7 and 8.

Referring to FIG. 5, the third form of an article dispensing structure is shown at 70 wherein pill 31 is retained in cavity 72 of sphere 73. Sphere 73 is composed of internally solid material 74 such as a plastic. Sphere 73 has protrusions 76 and 77 oppositely or 180 degrees disposed from each other adapted for being received into depressions 81 and 82 in the internal confines 84 of vessel 80 so as to enable sphere 73 to be rotated pivotally with respect to vessel 80 about axis 78 extending between protrusions 76 and 77. Axis 78 passes through the center of gravity of material 74 of the sphere and bisects sphere 73 in substantially two portions of equal weight. Rotational motion of sphere 73 about axis 78 is therefore obtained by inverting vessel 80, causing sphere 73 to cooperate with a planar member such as at 88 of FIG. 9, and impelling the sphere by exerting manual force upon vessel 80 while sphere 73 is in contact with the planar member. A recessed lip is provided at 83 for fitting vessel 80 to its cover as at 100.

The location and orientation of cavity 72 in sphere 73 is defined by an angle $\beta$ that constitutes an acute angle between axis 78 and a dashed line 79 intersecting within the center of protrusion 77. Such angle is generally 45 degrees but may vary between 30 and 60 degrees. In this manner article 31 will be scooped up from the internal confines 84 of vessel 80 by rotation of sphere 73, further discussed in conjunction with FIG. 9.

Figure 6:
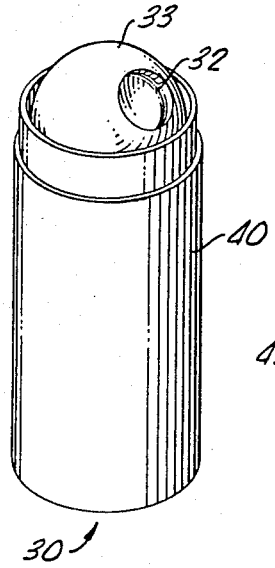
FIGS. 6, 7 and 8 are perspective views partially in cross-section of the article dispenser of either FIG. 3 or FIG. 4 illustrating the functions performed thereby.
Figure 7:
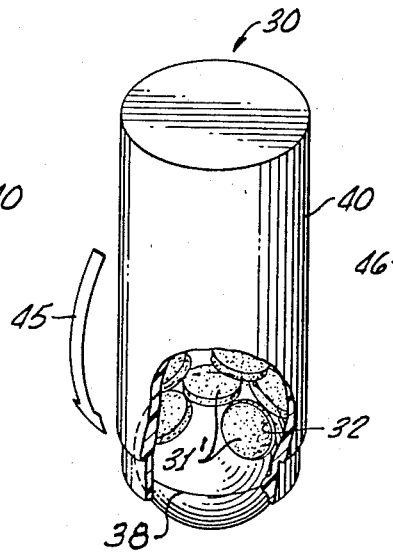
Figure 8:
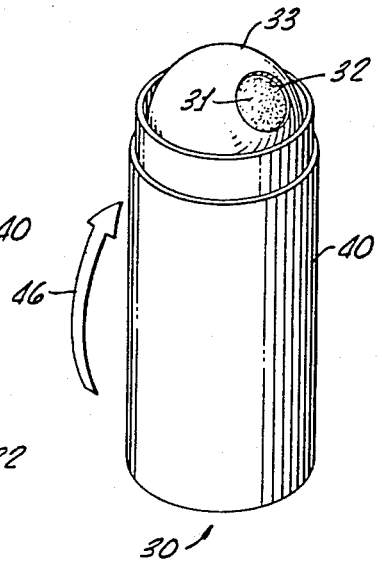

FIGS. 6, 7 and 8 illustrate the manner in which an article such as a pill 31 is transferred from its normal storage location to a location external either of dispensers 30 or 50 as depicted respectively in FIGS. 3 or 4.

FIG. 6 shows dispenser 30 in its normal position resting on the base of vessel 40 and displaying a portion of the first hemisphere of sphere 33, as discussed above, extending from the mouth of vessel 40 showing cavity 32 in sphere 33 external to the inner confines of vessel 40. Accordingly, there is no article or pill 31 in cavity 32 as yet.

FIG. 7 shows dispenser 30 being inverted 180 degrees from its normal position of FIG. 6, arrow 45 showing such inversion motion. The inversion as described by arrow 45 causes rotation only of vessel 40 about the axis of rotation of the vessel with respect to the sphere, so that article or pill 31', which is pill 31 in phantom, rests on the surface of sphere 33 but within the confines of vessel 40 ready to slide down towards one of the sphere's pivotal means and thereby get deposited in cavity 32.

FIG. 8 shows dispenser 30 being restored to its normal position by arrow 46 by similar rotational motion of vessel 40 about the pivotal means on which sphere 33 is suspended, thereby restoring the dispenser orientation to its normal position as in FIG. 6 but this time with article or pill 31 lying within cavity 32, ready for being removed therefrom.

An identical method is utilized to dispense article 31 by means of dispenser 50, shown in FIG. 4, wherein sphere 53 performs the identical function as sphere 33, and vessel 60 performs the identical function to that of vessel 40, delivering the article in cavity 52 of sphere 53.

Figure 9:
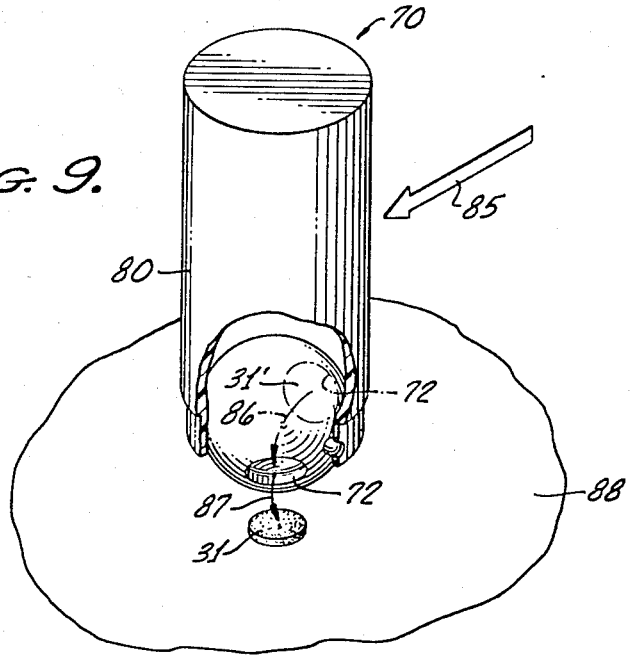
FIG. 9 is a perspective view partially in cross-section of the article dispenser of FIG. 5 illustrating the functions performed thereby.

FIG. 9 illustrates the means in which an article such as pill 31 is transferred from its normal storage location to a location external dispenser 70, as depicted in FIG. 5.

Vessel 80 is inverted with respect to its normal position so that article or pill 31 shown in phantom as at 31' slides into cavity 72 of sphere 73, which cavity is presently within the confines of vessel 80. Sphere 73 is in position to make contact with planar surface 88. Since there is no substantial imbalance in weight between hemispheres of sphere 73 the sphere and its vessel will not normally rotate with respect to each other without exertion of some external force upon the vessel. Hence, when vessel 80 is laterally pushed as indicated by arrow 85 so that the outer surface of sphere 73 translates in a rolling motion over planar surface 88, cavity 72 is repositioned outside the mouth of vessel 80 as indicated by motion arrow 86 thereby causing article 31 to fall out of cavity 72 as indicated by motion arrow 87 on to the surface of planar member 88.

We claim:

1. A dispenser incorporating a vessel and a ball structure pivotally coupled to the vessel, said vessel being capable of storing at least one article, characterized by:

a first half ball of said structure having a planar surface and a curved contour, said contour having a cavity therein;

a second half ball of said structure having a planar surface and a curved contour and being of a single homogeneous material throughout its internal volume, said second half ball being integrated with the first half ball at an interface of said planar surfaces, said second half ball being heavier than the first half ball; and pivotal means, adapted at two locations between the vessel and ball structure at said interface, for enabling rotation of said vessel with respect to the ball structure, said cavity being located in proximity of one of said two locations, said cavity being nearer to one of the two locations than to the other of said two locations.

2. The dispenser as stated in claim 1, wherein the curved contour of the first half ball and cavity constitute means for transferring the article from within the vessel to a point external of the vessel.

3. The dispenser as stated in claim 1, wherein the curved contour of the first half ball and cavity constitute means for transferring the article from within the vessel to a point external of the vessel.

4. The dispenser as stated in claim 1, wherein said first half ball is of substantially the same volume as the second half ball.

5. The dispenser as stated in claim 1, wherein the first half ball and the second half ball are of plastic materials.

6. The dispenser as stated in claim 1, wherein the first half ball and the second half ball are of different materials.

7. The dispenser as stated in claim 1, including a cover adapted to said vessel.

8. The dispenser as stated in claim 1, wherein said pivotal means constitutes a pair of pivotal assemblies, each of said assemblies constituting a depression in the ball structure, a like depression in the vessel and a bearing fitted into each said depression.

9. The dispenser as stated in claim 1, wherein said pivotal means constitutes a pair of pivotal assemblies, each of said assemblies constituting a depression in the wall of the vessel and a protrusion extending outwardly from the curved contours of the ball structure into each said depression.

10. The dispenser as stated in claim 1, wherein said pivotal means constitutes a pair of pivotal assemblies, each of said assemblies constituting a depression in the ball structure and a protrusion extending inwardly from the wall of said vessel into each said depression.

11. A dispenser incorporating a vessel and a sphere pivotally coupled to the vessel, said vessel being capable of storing at least one article, characterized by:

a first hemisphere of said sphere having a curved contour with a cavity therein and having a planar surface;

a second hemisphere of said sphere having a curved contour and a planar surface and being of a material that is homogeneous throughout its entire internal volume, said first and second hemispheres being integrated with each other at an interface of their planar surfaces, the second hemisphere being heavier than the first hemisphere; and pivotal means, adapted at two locations between the vessel and sphere at said interface, for enabling rotation of said vessel with respect to the sphere, said cavity being located nearer to one of said two locations than to the other of said two locations.

12. The dispenser as stated in claim 11, wherein the curved contour of the first hemisphere and cavity constitute means for transferring the article from within the vessel to a point external of said vessel.

13. The dispenser as stated in claim 11, wherein the first hemisphere is of substantially the same volume as the second hemisphere.

14. The dispenser as stated in claim 11, wherein the first and second hemispheres are of plastic materials.

15. The dispenser as state in claim 11, wherein the first and second hemispheres are of different materials.

16. The dispenser as stated in claim 11, wherein the first and second hemispheres are of the same material.

17. The dispenser as stated in claim 11, wherein said pivotal means constitutes a pair of pivotal assemblies, each of said assemblies constituting a depression in the sphere, a like depression in the vessel and a bearing fitted into each said depression.

18. The dispenser as stated in claim 11, wherein said pivotal means constitutes a pair of pivotal assemblies, each of said assemblies constituting a depression in the wall of the vessel and a protrusion extending outwardly from the curved contours of the sphere into each said depression.

19. The dispenser as stated in claim 11, wherein said pivotal means constitutes a pair of pivotal assemblies, each of said assemblies constituting a depression in the sphere and a protrusion extending inwardly from the wall of said vessel into each said depression.

20. A method of dispensing an article from a storing vessel equipped with a pivotally suspended sphere having a hemisphere with a cavity in proximity of the pivotal suspension, characterized by the steps of:

(a) inverting the dispenser thereby causing the hemisphere to be positioned facing the internal confines of the vessel;

(b) transferring the article from the vessel to the surface of the hemisphere, said article sliding along the spherical contour of the hemisphere into the cavity; and (c) restoring the dispenser to its initial position prior to execution of step (a) thereby causing the hemisphere with the cavity bearing the article to be positioned external to the inner confines of the vessel.

21. A dispenser incorporating a vessel capable of storing at least one article, characterized by:

a ball structure having a curved contour and being pivotally coupled at two locations to said vessel for rotation about one axis, said contour having a cavity therein that is nearer to one of said two locations than to the other of said two locations.

22. The dispenser as stated in claim 21, wherein said cavity constitutes means for transferring the article from within the vessel to a point external of the vessel.

* * * * *

UNITED STATES PATENT AND TRADEMARK OFFICE

CERTIFICATE OF CORRECTION

PATENT NO. : 4,522,313

DATED : June 11, 1985

INVENTOR(S) : Jennings, et al.

It is certified that error appears in the above—identified patent and that said Letters Patent is hereby corrected as shown below:

Column 4, line 51, change "be" to —by—.

Signed and Sealed this

*Fifteenth* Day of *April 1986*

[SEAL]

*Attest:*

DONALD J. QUIGG

*Attesting Officer*

*Commissioner of Patents and Trademarks*